US006285337B1

(12) United States Patent
West et al.

(10) Patent No.: US 6,285,337 B1
(45) Date of Patent: Sep. 4, 2001

(54) FERROELECTRIC BASED METHOD AND SYSTEM FOR ELECTRONICALLY STEERING AN ANTENNA

(75) Inventors: James B. West, Cedar Rapids; Bryan L. Hauck, Marion, both of IA (US)

(73) Assignee: Rockwell Collins, Cedar Rapids, IA (US)

( * ) Notice: Subject to any disclaimer, the term of this patent is extended or adjusted under 35 U.S.C. 154(b) by 0 days.

(21) Appl. No.: 09/654,734

(22) Filed: Sep. 5, 2000

(51) Int. Cl.[7] ..... H01Q 21/00

(52) U.S. Cl. ..... 343/853; 343/700 MS; 343/787

(58) Field of Search ..... 343/700 MS, 705, 343/708, 767, 754, 853, 787; 342/375

(56) References Cited

U.S. PATENT DOCUMENTS

| | | | | |
|---|---|---|---|---|
| 5,583,524 | | 12/1996 | Milroy | 343/772 |
| 5,617,103 | * | 4/1997 | Koscica et al. | 343/700 MS |
| 5,729,239 | * | 3/1998 | Rao | 343/753 |
| 6,081,235 | * | 6/2000 | Romanofsky et al. | 343/700 MS |

* cited by examiner

*Primary Examiner*—Tan Ho
(74) *Attorney, Agent, or Firm*—Nathan O. Jensen; Kyle Eppele

(57) ABSTRACT

A system and method for changing an emission pattern of a concave phased array antenna where a ferroelectric material having voltage variable dielectric constant is used as a substrate for a concave radiation surface, and phase delays can be induced by changing voltages applied across the ferroelectric material.

20 Claims, 4 Drawing Sheets

FERROELECTRIC BASED METHOD AND SYSTEM FOR ELECTRONICALLY STEERING AN ANTENNA

FIELD OF THE INVENTION

The present invention generally relates to radar and radio antennae, and more particularly relates to antenna systems having electronic steering, and even more particularly relates to methods and systems for providing a ferroelectric phased array antenna with reduced cost.

BACKGROUND OF THE INVENTION

Phased array theory and technology have been in existence for more than 30 years. Phased array antennae have been used most extensively in the past in military systems, such as airborne and ground-based fire control radar systems. They do have several common problems relating to high cost, including the relatively high cost of: a) phase shifter technology; b) phase shifter beam steering controller networks; and c) the high number of RF and control interconnects required for phased array antennae of even moderate size. As an example, a two-dimensional array of one thousand radiating elements can often require up to one thousand phased shifters, each with commensurate RF interconnect, digital control, and a sophisticated system level beam steering computer. While standard techniques, such as sub-arraying and row/column phase shifter steering, help reduce the interconnect problem with reduced performance, cost is still a major issue. Even state-of-the-art monolithic microwave integrated circuit (MMIC) based active phased arrays suffer from excessive cost.

Another prior art approach is described in U.S. Pat. No. 5,583,524. While this design has considerable benefits, it does have some drawbacks. It is not the most ideal antenna for all applications.

Consequently, there is a need for improvements in affordable phased array antenna systems.

SUMMARY OF THE INVENTION

It is an object of the present invention to provide a system and method for electronically steering an antenna beam.

It is a feature of the present invention to utilize a phased array antenna with a ferroelectric material therein.

It is another feature of the present invention to include an antenna conformally shaped to a fuselage of an aircraft.

It is an advantage of the present invention to achieve electronic beam steering in an affordable antenna.

The present invention is an apparatus and method for electronically steering an antenna, which is designed to satisfy the aforementioned needs, provide the previously stated objects, include the above-listed features, and achieve the already articulated advantages. The present invention is carried out in a "one axis phase shifter module-less" manner in a sense that the use of phase shifter modules to control one axis scanning has been greatly reduced. The present invention is also carried out in a "wasted space-less" manner in the sense that the space that is often wasted when a non-conformal antenna is used has been greatly reduced.

Accordingly, the present invention is a system and method for electronically steering an antenna which uses a ferroelectric material as a dielectric in an antenna system.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1A:
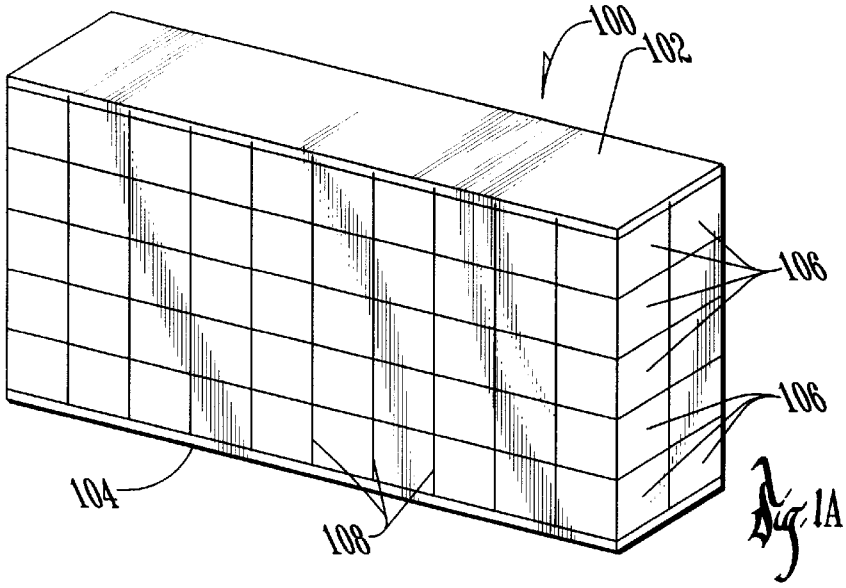
FIG. 1A is a perspective view of a planar antenna of the present invention, which shows a matrix of ferroelectric cells, where the vertical lines represent adhesive material binding the ferroelectric cells.

Now referring to the drawings wherein like numerals refer to like matter throughout, and more specifically referring to FIG. 1A, there is shown a representative one-dimensional planar sub-panel array generally designated 100, including a slotted radiation surface 102. Slotted radiation surface 102 is preferably made by masking slots during a metal deposition process to arrive at the thin slotted radiation surface 102. Opposing slotted radiation surface 102 is ground plane 104, which is well known in the art. Disposed between slotted radiation surface 102 and ground plane 104 are a plurality of ferroelectric sub-cells 106, which are held together by adhesive joints 108. The material in ferroelectric sub-cells 106 is preferably from the tungsten bronze family of materials which have filled structure such as BSTN and related crystals if they are found to have a lower loss characteristic. The term "ferroelectric" is used herein to describe a material having a dielectric constant which is a function of applied voltage. The adhesive joints 108 may be made of any well-known conductive adhesive or any well-known insulating adhesive, depending upon the particular design parameters. Array 100 is shown having a depth of two ferroelectric sub-cells 106; this number may be varied, depending upon the size of available ferroelectric sub-cells 106 and the particular design requirements.

Figure 1B:
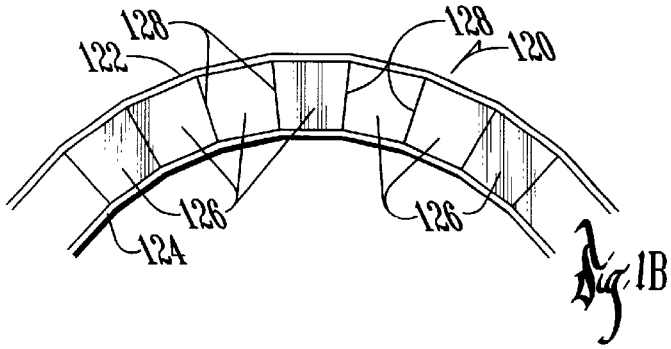
FIG. 1B is an edge-on view of a conformal antenna of the present invention.

Now referring to FIG. 1B, there is shown a one-dimensional chamfered sub-panel array 120, which may be identical to sub-panel array 100 except for the shape and configuration of the elements. Chamfered array 120 is shown having a conformal slotted radiation surface 122 and a conformal ground plane 124 with a plurality of chamfered ferroelectric sub-cells 126 disposed therebetween which are connected via a plurality of adhesive joints 128.

For both FIGS. 1A and 1B, the resulting structure is a one-dimensional sub-panel array of slotted radiators. By proper choice of the slot spacing, substrate thickness, ferroelectric material properties, etc., one-dimensional scanning can be achieved by changing an applied direct current (DC) voltage (static electric bias field) across the ferroelectric substrate. The change in substrate voltage in turn perturbs the relative dielectric constant of the ferroelectric substrate and thereby introduces a phase scan perpendicular to the axis of the radiation slot.

Such an antenna may be fed by transverse electromagnetic (TEM) feed manifold.

Figure 2:
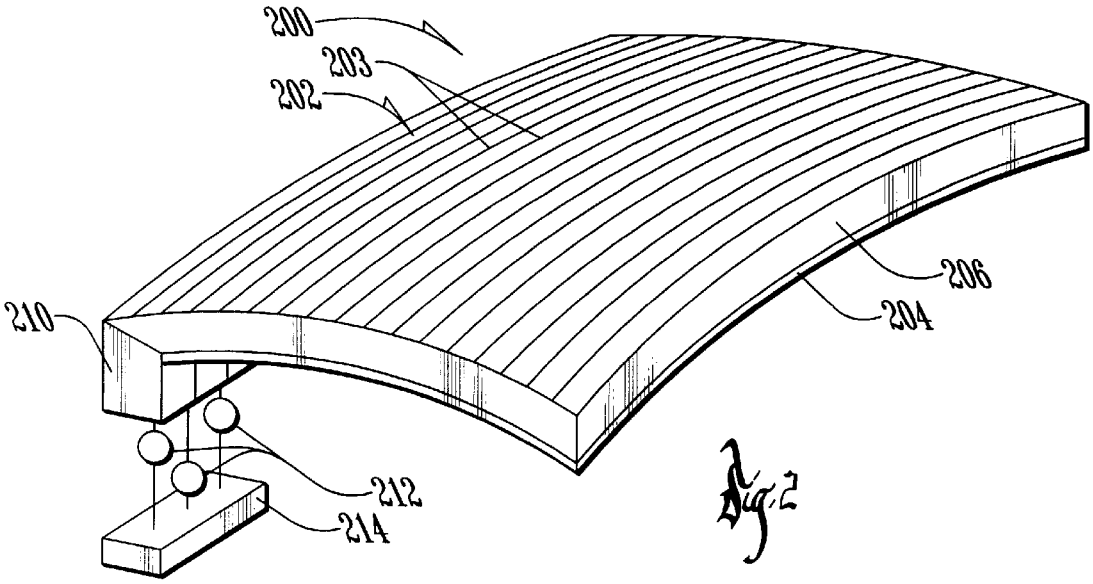
FIG. 2 is a perspective view of a two-dimensional conformal antenna of the present invention.

Now referring to FIG. 2, there is shown a two-dimensional arbitrary shaped conformal antenna array 200 of the present invention, which is shown to have curved sides so as to better conform to predetermined shape of an aircraft fuselage section. Arbitrary shaped conformal antenna array 200 includes an arbitrary shaped conformal antenna slotted radiating surface 202 which is similar to conformal slotted radiation surface 122 of FIG. 1B. Opposing arbitrary shaped conformal antenna slotted radiating surface 202 is arbitrary shaped conformal antenna ground plane 204, which is similar to conformal ground plane 124 of FIG. 1. Disposed between arbitrary shaped conformal antenna slotted radiating surface 202 and arbitrary shaped conformal antenna ground plane 204 is arbitrary shaped conformal ferroelectric sub-panel array 206, which is made of the same material as described above for ferroelectric sub-cells 106 and chamfered ferroelectric sub-cells 126. Arbitrary shaped conformal antenna array 200 is fed with linear array signal feed 210 having a plurality of phase shifters 212 and a signal input manifold 214.

The phase shift achieved by phase shifters 212 can be realized with a ferroelectric-based device or by conventional phase shifter technology. Also, while phase shifters 212 are shown as discreet phase shifters, the phase shift could be accomplished by distributed phase shifters/techniques as well.

Arbitrary shaped conformal antenna array 200 can be fabricated using many techniques; however, the following is believed to be preferred.

Two dimensionally arched ferroelectric sub-panels are fabricated with techniques and materials similar to those discussed above for the one-dimensional chamfered and planar arrays. Several of these chamfered ferroelectric sub-panels, with arched groundplanes thereon, are integrated with adhesive joints to form the arbitrary shaped conformal antenna array 200. Each arched sub-panel, or sub-array of slots of the arbitrary shaped conformal antenna array 200 will be capable of independent phase shift due to the DC isolation between the radiation slots on the arbitrary shaped conformal antenna slotted radiating surface 202. This will allow for the curvature of the antenna to be compensated for by adjusting the amount of phase shift at each individual sub-panel of the arbitrary shaped conformal antenna array 200. This flexibility adds to the usefulness of the arbitrary shaped conformal antenna array 200 and allows for tighter radii of curvature.

It is anticipated that each sub-panel will be fed through one, or more, coaxially excited E field probes or alternately through slot aperture coupling. The linear array signal feed 210 follows the radius of curvature of the array, and the feed curvature is compensated for to properly excite the sub-panels.

An arbitrary conformal shape, as shown in FIG. 2, is a natural extension of the techniques previously described. The chamfered sub-panel approach is extended to conform to arcs in two dimensions. One embodiment of the invention is still a monolithic TEM guide structure with a series of electrically long arbitrary shaped conformal slots 203, but with two important distinctions: 1) each arbitrary shaped conformal slot 203 is now curved, rather than geometrically linear, and 2) the monolithic TEM traveling wave waveguide radiating from the arbitrary shaped conformal slots 203 is now non-planar. The sub-panels can be constructed with various sized and shaped ferroelectric sub-cells that have chamfers on all four edges.

The sub-cell and sub-panel shapes are designed such that any arbitrary shaped panel can be approximated after final assembly. Metallic deposition is performed after the sub-panels are assembled into the final array, arbitrary shaped conformal antenna array 200. The arbitrary shaped conformal slots 203 are realized by masking selective areas on the arbitrary shaped conformal antenna slotted radiating surface 202, (the surface opposing the arbitrary shaped conformal antenna ground plane 204) of the composite ferroelectric structure during the metal deposition process. Note that it is possible to realize an approximation to a hemispherical dome-shaped array with this approach for wide-angle azimuthal and elevation scan coverage. The non-planar shape of the arbitrary shaped conformal antenna array 200 can be compensated for by adjusting bias voltages applied across the ferroelectric material in the plurality of sub-cells and by inducing a phase shift through phase shifters in the signal feed input mechanism.

The arbitrary shaped conformal slots 203 provide DC isolation between the sub-panels, or sub-array of slots. It is possible to have one or more of the arbitrary shaped conformal slots 203 reside within a given sub-panel. It is again anticipated there will be either an E-field probe or aperture coupling between the linear array signal feed 210 and each sub-panel. The linear array signal feed 210 will likely be physically located toward a peripheral edge of the arbitrary shaped conformal antenna array 200 and on the inner surface of the composite assembly. The linear array signal feed 210 will be designed in such a fashion as to follow the radius of curvature of the arbitrary shaped conformal antenna array 200 and properly excite the sub-panels.

Figure 3:
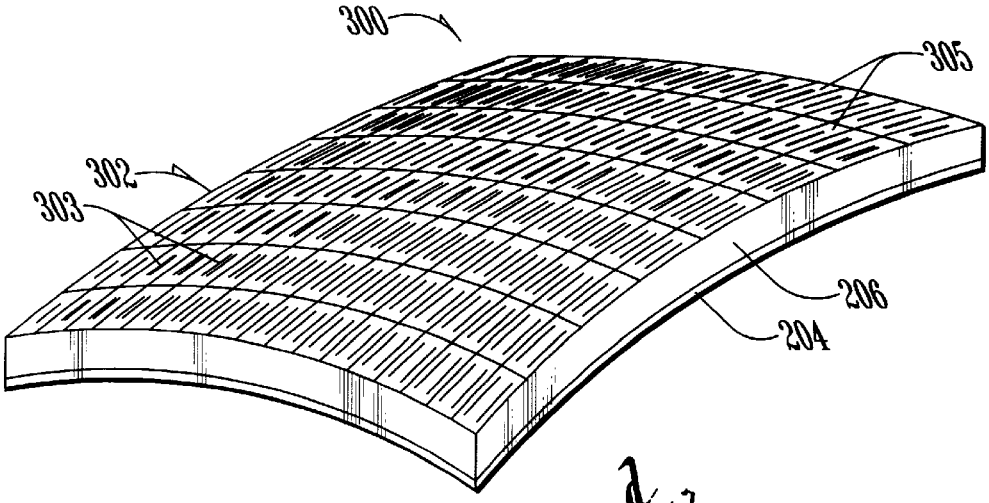
FIG. 3 is a perspective view of an alternate conformal antenna of the present invention having a plurality of discrete printed sub-panels where each sub-panel is capable of individual voltage bias.
Figure 4:
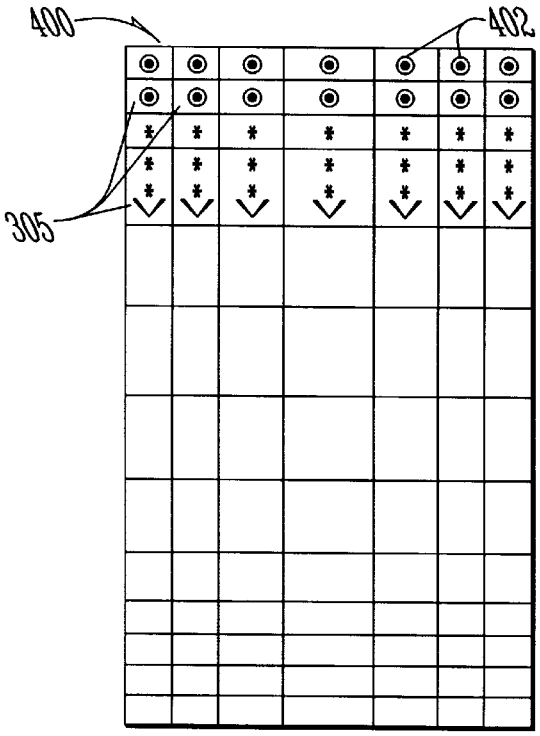
FIG. 4 is a planar projection of the inner surface of the array of FIG. 3.
Figure 5:
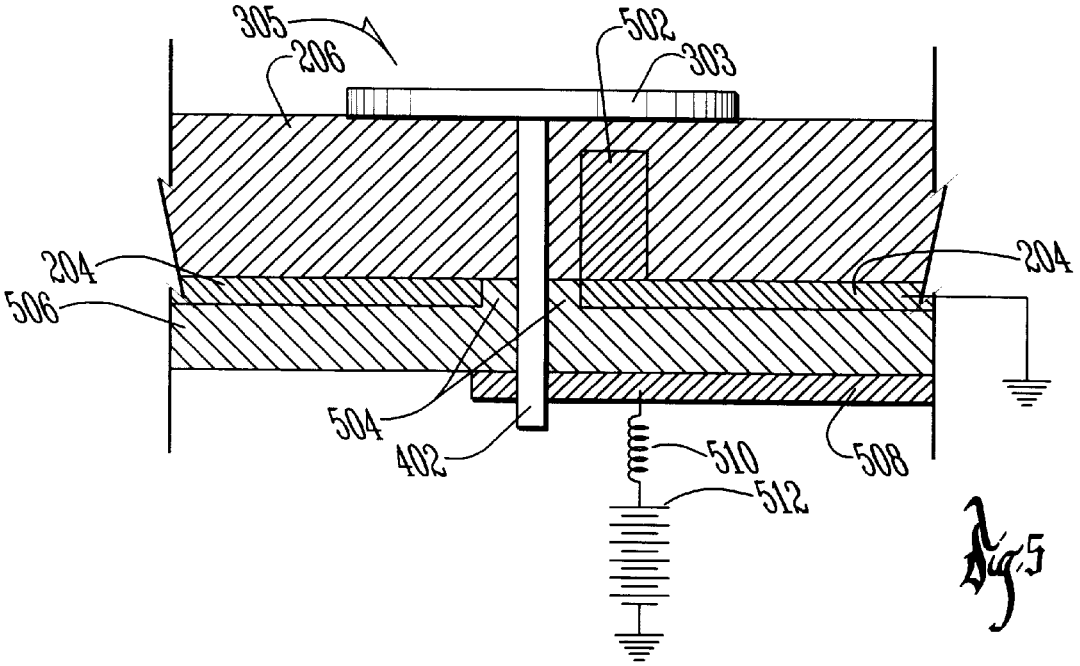
FIG. 5 is an enlarged cross-sectional view of a single sub-panel of the antenna of FIG. 3.
Figure 6:
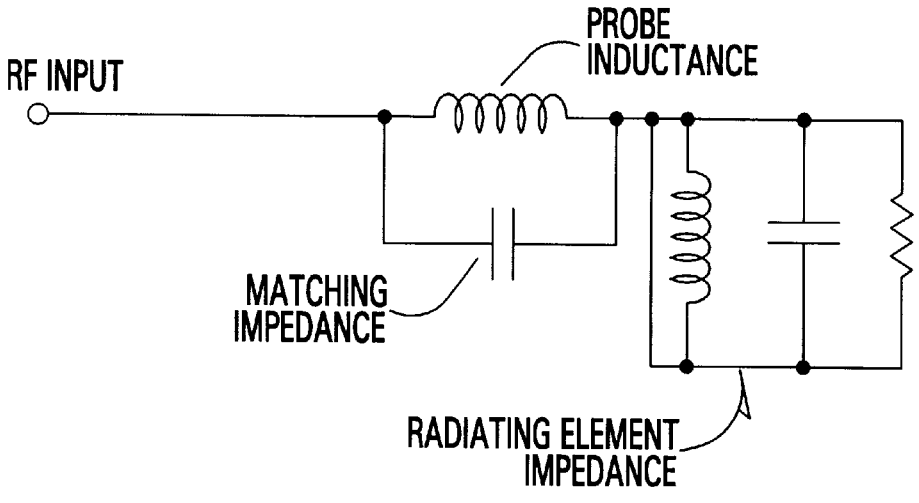
FIG. 6 is an equivalent circuit of the single sub-panel of FIG. 5.

Now referring to FIGS. 3–6, there is shown an alternative embodiment of the arbitrary shaped conformal antenna array 200 of FIG. 2. In this case, each ferroelectric sub-cell can be individually biased via an RF impedance matched bias probe assembly. A conformal printed circuit board can then supply DC signals to each bias probe. This approach is attractive for arrays consisting of discrete printed elements, such as printed dipole, or microstrip patches, or resonant slots in a top-side ground plane, where it is desirable to have a non-linear static electric field gradient in one, or more, dimensions across the face of the phased array for additional phase shift control. The general conformal array is shown in FIG. 3, which includes an arbitrary shaped conformal printed surface antenna array 300, which is shown having an arbitrary shaped conformal radiating top surface mosaic of printed radiation elements 302, which is comprised of an array of printed radiation elements 303 in a plurality of sub-cells 305. A planar projection 400 of the inner surface of the arbitrary shaped conformal radiating top surface mosaic of printed radiation elements 302 illustrating the grid of isolated ferroelectric sub-cells 305, and the array of DC bias probes 402, is shown in FIG. 4. A cross-sectional view of each sub-cell 305 and its associated DC bias probe 402 is shown in FIG. 5. FIG. 5 shows a matching structure 502 to resonate probe inductance 402, which is used to compensate for the effects of DC bias probe 402. DC bias probe 402 is isolated by ground plane probe isolation areas 504. Dielectric substrate 506 separates flexible PCB 508 from arbitrary shaped conformal antenna ground plane 204. Flexible PCB 508 can be a microstrip board which carries the DC bias voltage and possibly the signal feed. Flexible PCB 508 is preferably conformal to the contour shape of the arbitrary shaped conformal printed surface antenna array 300. The DC bias probe 402 is driven by DC bias voltage source 512 in conjunction with RF choke inductor 510, which provides an RF block to this DC feed. The equivalent circuit for each of the sub-cells 305 and its DC bias probe 402, with the required matching circuitry, is shown in FIG. 6. FIG. 6 depicts a design where the signal feed is accomplished through DC bias probe 402. In other circumstances, alternate feed approaches are envisioned.

Figure 7:
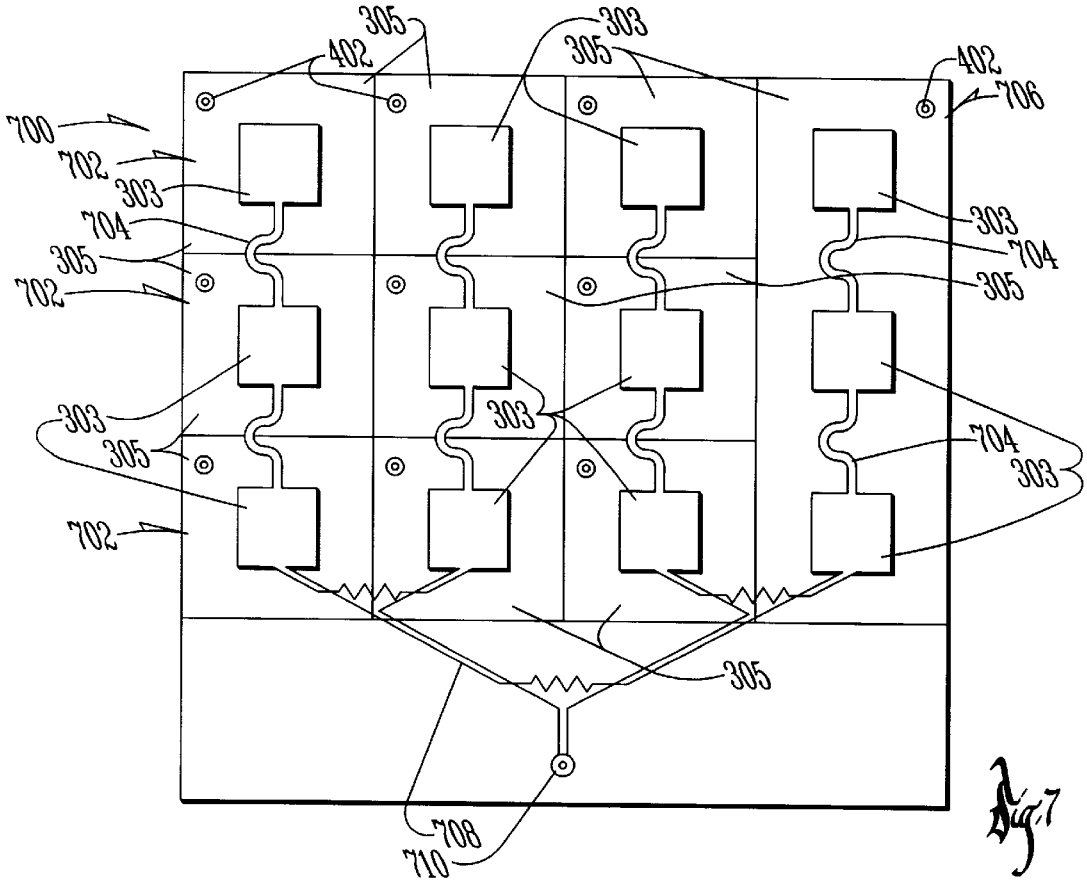
FIG. 7 is an alternate embodiment of the present invention which includes top-side series and corporate feed networks.

Now referring to FIG. 7, there is shown a top signal feeding network 700 which illustrates one such alternate embodiment where the RF signal is not routed to the printed radiation elements 303 through ferroelectric sub-cell DC bias probe 402. Top-side, series and corporate feed networks are shown in this embodiment. Each of the sub-cells 305 has one or more printed radiation elements 303 thereon which is driven by a microstrip connection line 704 with an adjacent printed radiation element 303. Series fed linear array section 702 represents a linear section of sub-cells 305 which are driven together. In series fed linear array section 702, each of the sub-cells 305 has a single printed radiation element 303 and a DC bias probe 402 for providing independent control. In contrast, a large sub-cell having multiple radiating elements 706 is shown having a single DC bias probe 402. Note that the dielectric constant—locally under each radiating element—can be individually controlled by means of the sub-cell's applied DC voltage, via DC bias probe 402. Groups of series fed linear array sections 702 can be fed by a N-way Wilkensen or other standard combiner network or corporate feed network 708 and signal input feed 710.

Figure 8:
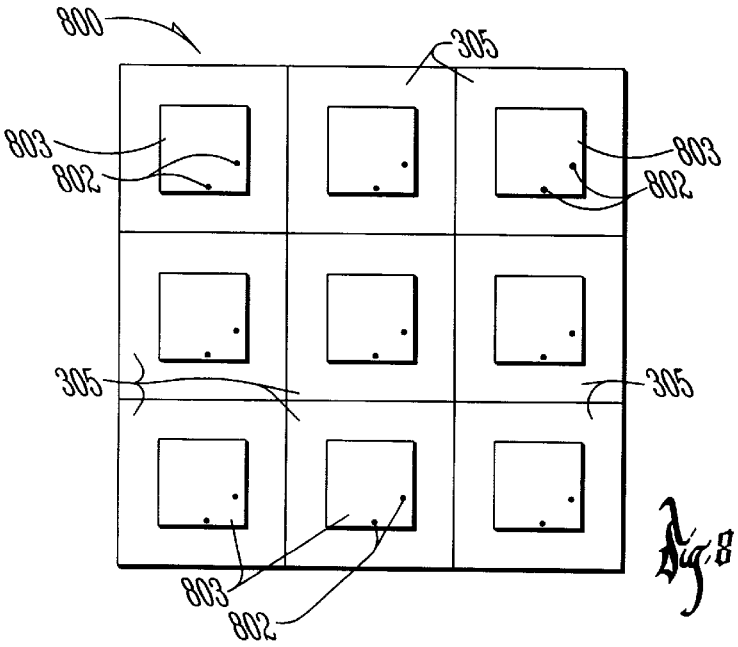
FIG. 8 is another alternate embodiment of the present invention in which each sub-panel has dual probes.

FIG. 8 is a dual probe variation of the single probe method shown in FIGS. 4–5 (where the DC bias probe 402 used to bias the arbitrary shaped conformal radiating top surface mosaic of printed radiation elements 302 and can also used to distribute the RF signal to the printed radiation elements 303). Now referring to FIG. 8, there is shown a dual probe array 800 of sub-cells 305 wherein each of the sub-cells 305 includes a radiating element having dual probes 803, wherein each of the two DC bias and signal feed probes 802 is used to both provide DC bias and signal feed. The use of two DC bias and signal feed probe 802 per sub-cells 305 allows for the generation of circularly, or more generally elliptically polarized radiation patterns.

Throughout this description, reference is made to aircraft, because it is believed that the beneficial aspects of the present invention would be most readily apparent when used in connection with an aircraft; however, it should be understood that the present invention is not intended to be limited to aviation uses and should be hereby construed to include other designs as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

We claim:

1. A phased array antenna comprising:

a ferroelectric member, having an orthogonal stub free top side and a bottom side;

a ground plane, disposed on said bottom side;

a radiation surface disposed on said top side;

said radiation surface having thereon a plurality of radiation elements;

a signal feed, coupled to said plurality of radiation elements, for providing a signal to be radiated to said plurality of radiation elements; and, a variable DC voltage source for providing a DC voltage across said ground plane and said radiation surface, so that a controllable phase delay can be induced in signals emitted from said plurality of radiation elements, by varying said DC voltage.

2. An antenna of claim 1 wherein said radiation surface is free of orthogonal stub radiating elements thereon.

3. An antenna of claim 2 wherein said ferroelectric member is comprised of a plurality of arrays wherein each array is comprised of a plurality of ferroelectric sub-cells coupled together with an adhesive material.

4. An antenna of claim 1 wherein said signal to be radiated is applied to a plurality of arrays of radiation elements, via a TEM manifold.

5. An antenna of claim 4 wherein each of said plurality of arrays of radiation elements has coupled thereto a phase shifter.

6. An antenna of claim 5 wherein said DC voltage is applied through a metal post extending through said ground plane to said radiation surface, in each of said plurality of sub-cells.

7. An antenna of claim 6 wherein said ferroelectric material is BSTN.

8. An antenna of claim 6 wherein said ferroelectric material includes tungsten and was a filled structure.

9. An antenna of claim 6 wherein each of said sub-cells has an impedance matching structure disposed therein to affect resonance of inductance caused by said metal post.

10. An antenna of claim 9 wherein said metal post is coupled to said signal feed.

11. An antenna of claim 10 wherein each of said plurality of sub-cells has two metal posts therein, so as to provide for circularly polarized radiation emissions.

12. An antenna of claim 6 further comprising a signal feed network disposed above said top side.

13. An antenna of claim 12 wherein said plurality of radiation elements is printed above said top side.

14. An antenna of claim 13 wherein said signal feed network further comprises a N-Way Wilkensen or other type of standard combiner feed network.

15. An antenna of claim 14 wherein said ferroelectric member is curved with a non-constant radius of curvature.

16. An antenna of claim 1 wherein said ferroelectric member is planar.

17. An antenna of claim 1 wherein said ferroelectric member is curved with a non-constant radius of curvature.

18. A phased array antenna comprising:

a concave ferroelectric member, having a top side and a bottom side;

a concave ground plane disposed on said bottom side;

a concave radiation surface disposed on said top side;

said radiation surface having thereon a plurality of radiation elements;

a signal feed, coupled to said plurality of radiation elements, for providing a signal to be radiated to said plurality of radiation elements; and, a variable DC voltage source for providing a DC voltage across said ground plane and said radiation surface, so that a controllable phase delay can be induced in signals emitted from said plurality of radiation elements, by varying said DC voltage.

19. A phased array antenna comprising:

concave means for radiating energy;

concave means for providing a voltage reference;

concave means for variably effecting a voltage dependent change in a dielectric constant existing in a ferroelectric material between said concave means for radiating and said concave means for providing a voltage reference; and, means for providing a signal to said concave means for radiating energy;

whereby a phase difference can be induced in radiated energy when a voltage is applied across said ferroelectric material.

20. A method of changing a pattern of emission from an antenna comprising the steps of:

providing a non-planar radiation surface having a plurality of independent radiation elements thereon;

providing a non-planar ground plane;

providing a non-planar ferroelectric material disposed between said non-planar radiation surface and said non-planar ground plane;

providing a variable voltage supply across the non-planar ferroelectric material;

providing a bias voltage to predetermined portions of said non-planar ferroelectric material to compensate for effects of curvature of said non-planar radiation surface;

providing a signal to be radiated;

shifting phase characteristic of said signal through phase shifters located in signal input mechanism; and, manipulating said variable voltage supply to change a dielectric constant of said non-planar ferroelectric material and thereby inducing a change in a pattern of emission.

* * * * *